US007478923B2

(12) United States Patent
Hsu

(10) Patent No.: US 7,478,923 B2
(45) Date of Patent: Jan. 20, 2009

(54) MULTICOLOR LIGHT-EMITTING DIODE LIGHT STRING AND LIGHT-EMITTING DIODE COMPONENT THEREOF

(75) Inventor: Sheng-Hung Hsu, Kaohsiung Hsien (TW)

(73) Assignee: Gemmy Industries Corporation, Coppell, TX (US)

( * ) Notice: Subject to any disclaimer, the term of this patent is extended or adjusted under 35 U.S.C. 154(b) by 0 days.

(21) Appl. No.: 11/725,056

(22) Filed: Mar. 16, 2007

(65) Prior Publication Data

US 2008/0224622 A1 Sep. 18, 2008

(51) Int. Cl.
*F21V 9/00* (2006.01)

(52) U.S. Cl. ..... 362/231; 362/249; 362/800; 313/512; 257/99

(58) Field of Classification Search ..... 362/231, 362/236, 249, 252, 800; 313/512; 257/99, 257/100

See application file for complete search history.

(56) References Cited

U.S. PATENT DOCUMENTS 7,067,848 B1 * 6/2006 Lee et al. ..... 257/99

* cited by examiner

*Primary Examiner*—John A Ward
(74) *Attorney, Agent, or Firm*—Alan Kamrath; Kamrath & Associates PA

(57) ABSTRACT

A multicolor light-emitting diode (LED) light string includes multiple serially connected LED components. Each LED component includes multiple chips and multiple pairs of positive and negative pins. The pairs of the positive and negative pins are respectively and electrically connected to positive and negative poles of the corresponding LED chip. Further, the LED chips with the same light color are serially connected through the positive and negative pins. In this way, the LED light string can be driven by different voltage sources at different times to show different light colors.

2 Claims, 5 Drawing Sheets

MULTICOLOR LIGHT-EMITTING DIODE LIGHT STRING AND LIGHT-EMITTING DIODE COMPONENT THEREOF

BACKGROUND OF THE INVENTION

1. Field of the Invention

The invention relates in general to a multicolor light-emitting diode (LED) light string and a light-emitting diode component thereof and, more particularly, to a multicolor LED light string and an LED component thereof that can show different single colors.

2. Description of the Related Art

With reference to FIG. 4, a conventional multicolor light-emitting diode (LED) component (50) includes three LED chips (51, 52 and 53) which can show different colors, a four-pins stand 54 and a transparent seal part (55). The four-pins stand 54 includes a common ground connection pin (541), a base (545) and three positive pins (542, 543, and 544). The three positive pins (542, 543, and 544) are connected to the base (545) and also coupled to corresponding positive poles of the LED chips (51, 52 and 53). On the other hand, the negative poles of the LED chips (51, 52 and 53) are coupled to the common ground connection pin (541) by wire-bonding or by other electrically connection methods.

The transparent seal part (55) is used to seal the portions of the four-pins stand (54) and the LED chips (51, 52, and 53), so that only the left parts of the four pins of the four-pins stand (54) are exposed outside.

With further reference to FIG. 5, an equivalent circuit diagram shows multiple LED components (50) to make up a light string (60). The light string (60) shows mixed color by the LED chips (51, 52 and 53) of different colors. However, the aforesaid LED components (50) use the single common ground connection pin (541) to make three ground connection terminals of the LED chips (51, 52 and 53) coupled together to the common ground connection pin (541). Hence, there is only one ground connection pin.

When the LED components (50) are serial serially connected together, aside from the first LED components (50), the three positive pins (542, 543, and 544) of the LED components (50) have to be coupled together, so as to be coupled to the ground connection pin (541) of the previous LED component (50). In this way, multiple LED components (50) are connected in serial to constitute the light string (60). Thereby, the three LED chips (51, 52, and 53) of each LED component (50) are connected in parallel.

It can be understood from the above description that the light string is formed by parallel connected LED chips in the LED components. In this way, when power is supplied to the light string, all LED chips are lit at the same time. Therefore, the conventional light string only shows one color and can not show multiple colors by only lighting up one single LED chip.

SUMMARY OF THE INVENTION

An objective of the present invention is to provide a multicolor light-emitting diode (LED) light string and a light-emitting diode component thereof to make the LED light string show different colors by different voltage source supplies, so as to enhance a control method and to show multiple colors.

In order to achieve the above-described objectives, the LED light string includes multiple serially connected LED components. Each LED component includes multiple LED chips having different voltages to illuminate different light colors, a chip stand and a housing. The chip stand includes multiple pair of positive and negative pins. The pairs of the positive and negative pins are respectively and electrically connected to positive and negative poles of the corresponding LED chips to constitute a serially connected LED component. Therefore, the LED light string uses different external voltages to electronically connect to corresponding serially connected LED components for lighting. The housing is used for sealing the pins of the LED chips.

Since the LED chips of the LED components are not coupled together to connect to the ground, each of the LED chips can be regarded as a single light source. Hence, the present invention is to make the LED components serially connected together, and then to make the LED chips of corresponding color serially connected together, so as to form multicolor light string circuits. The multicolor light string circuits are then connected to different voltage sources, so that the LED light string of the present invention can show different light colors by controlling output time of the voltage sources.

DETAILED DESCRIPTION OF THE INVENTION

Figure 1:
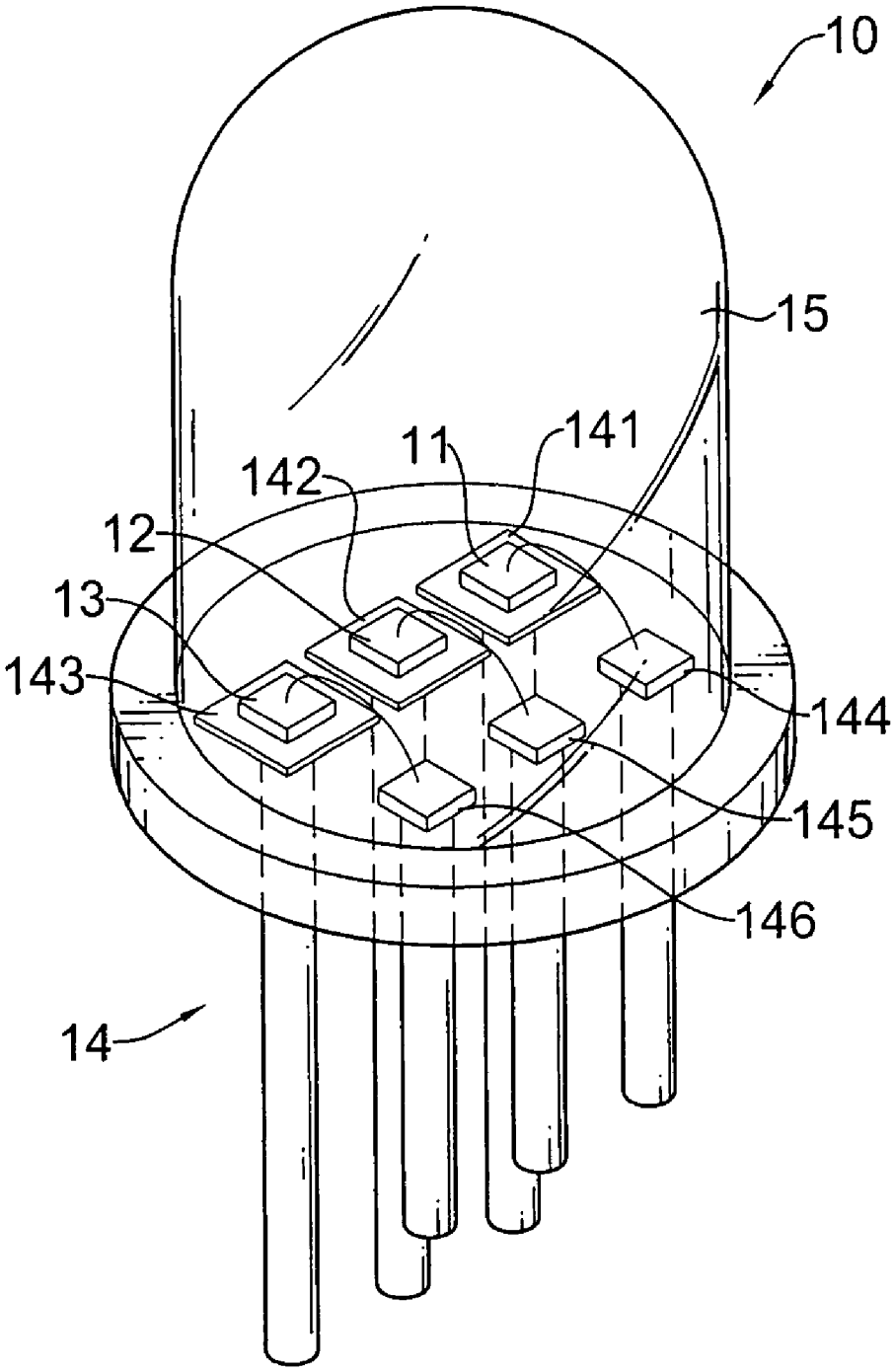
FIG. 1 is a top and front view of a preferred embodiment of a light-emitting diode (LED) component of the present invention.
Figure 2:
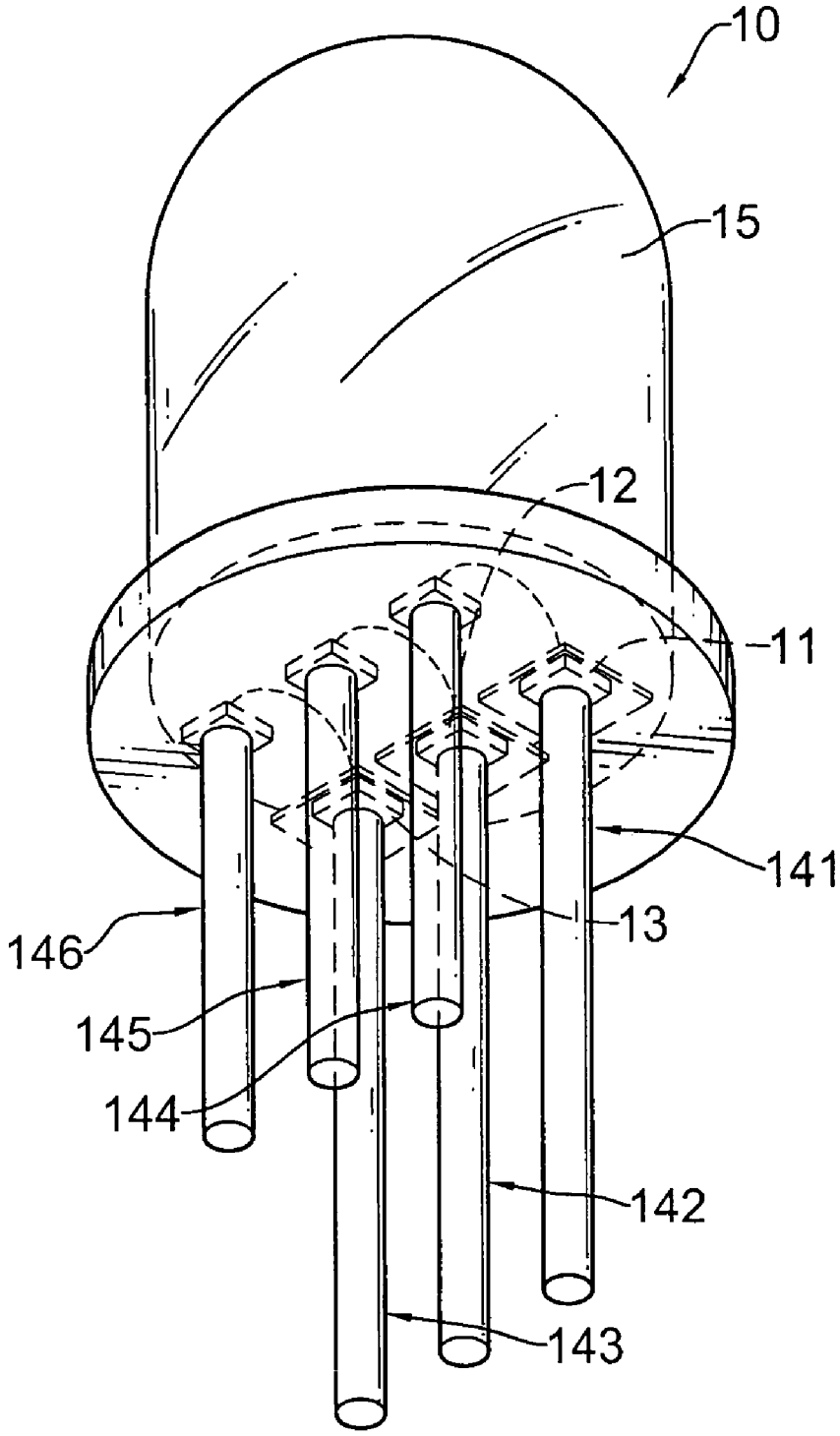
FIG. 2 is a bottom and front view of a preferred embodiment of the LED component of the present invention.

With reference to FIG. 1 and FIG. 2, a light-emitting diode (hereafter LED) component 10 of the present invention includes multiple LED chips (11, 12 and 13) having different voltages to illuminate different light colors, a chip stand 14 and a housing 15. Each LED chip (11,12, or 13) has a positive pole and a negative pole.

The chip stand 14 includes multiple pairs of positive and negative pins (141,144), (142, 145) and (143, 146). Each pair of the positive and negative pins (141,144), (142, 145) and (143, 146) is electrically connected to the positive and negative poles of the corresponding LED chips (11, 12 and 13). Therefore, the LED chips (11,12 and 13) are respectively driven by input corresponding voltage sources. In this example of a preferred embodiment, the positive poles of the LED chips (11, 12 and 13) are respectively coupled to the corresponding positive pins (141, 142 and 143). The negative poles of the LED chips (11, 12 and 13) are respectively coupled to the corresponding negative pins (144, 145 and 146) by wire-bonding.

The housing (15) seals the upper portion of each of the positive and negative pins (141,144), (142, 145) and (143, 146) and the LED chips (11, 12 and 13). A15

Figure 3:
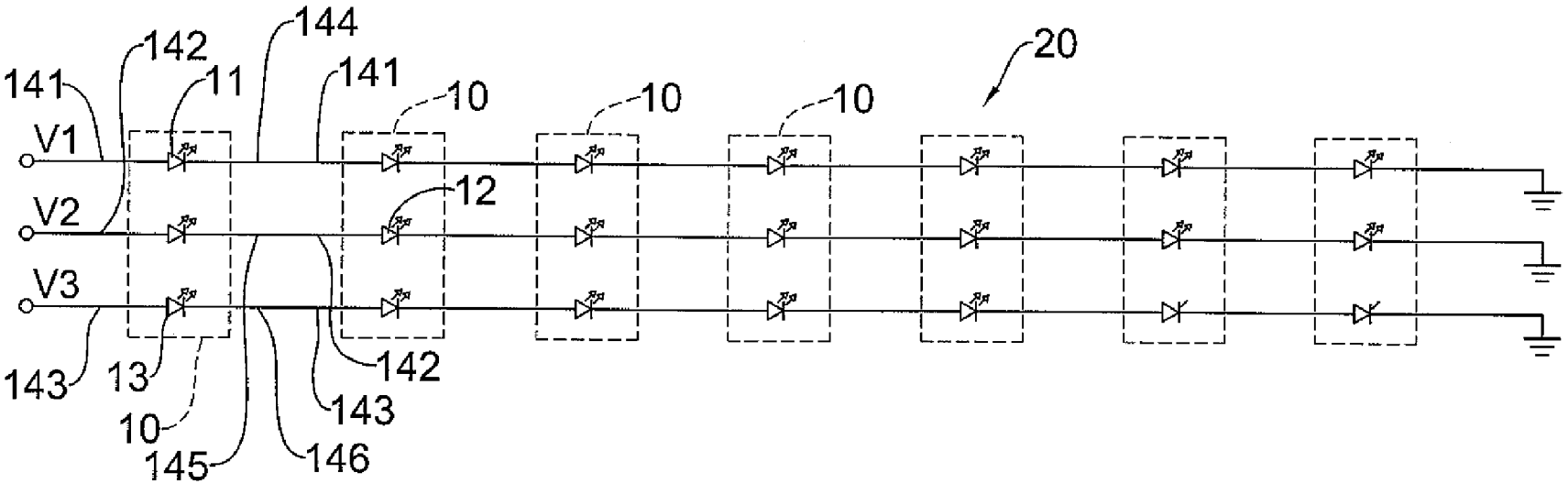
FIG. 3 is a preferred embodiment example of an equivalent circuit diagram of an LED light string of the present invention.
Figure 4:
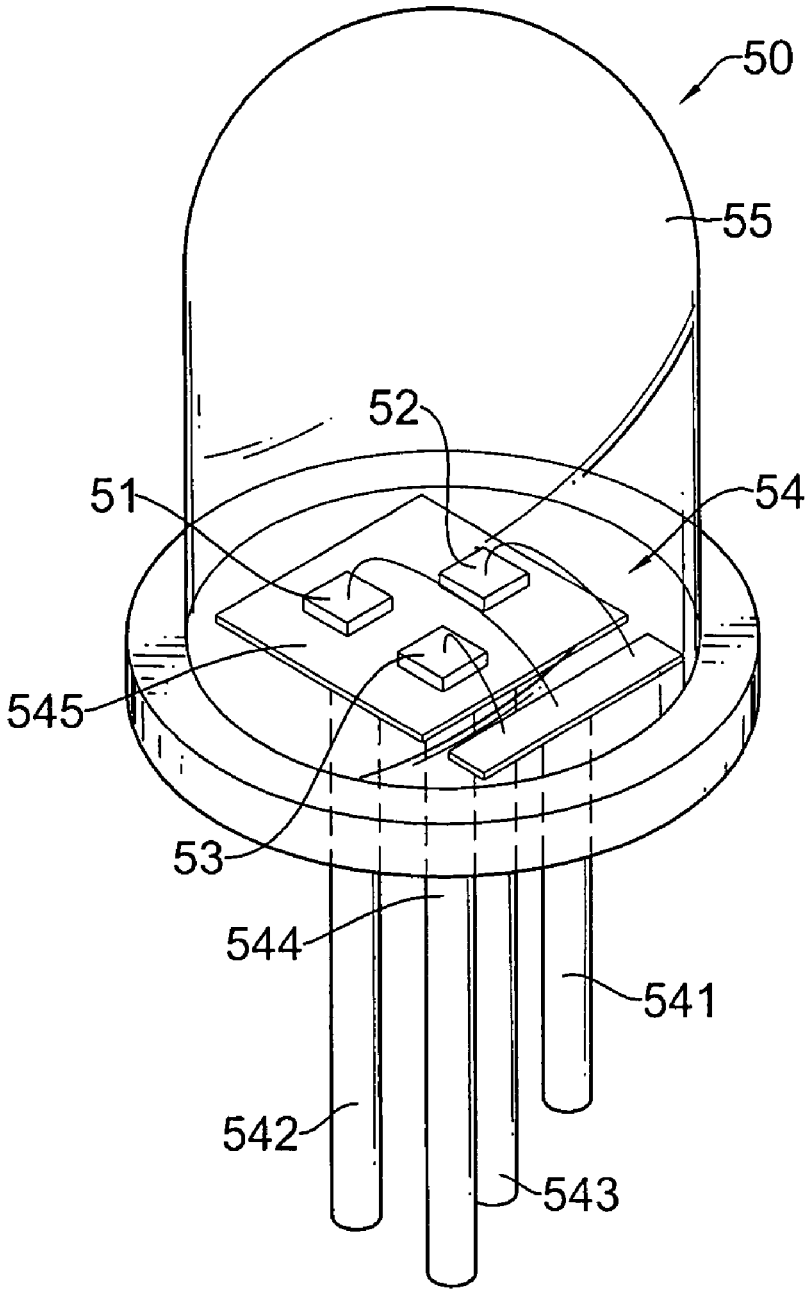
FIG. 4 PRIOR ART
FIG. 4 is a perspective view of a conventional LED component in accordance with the prior art.
Figure 5:
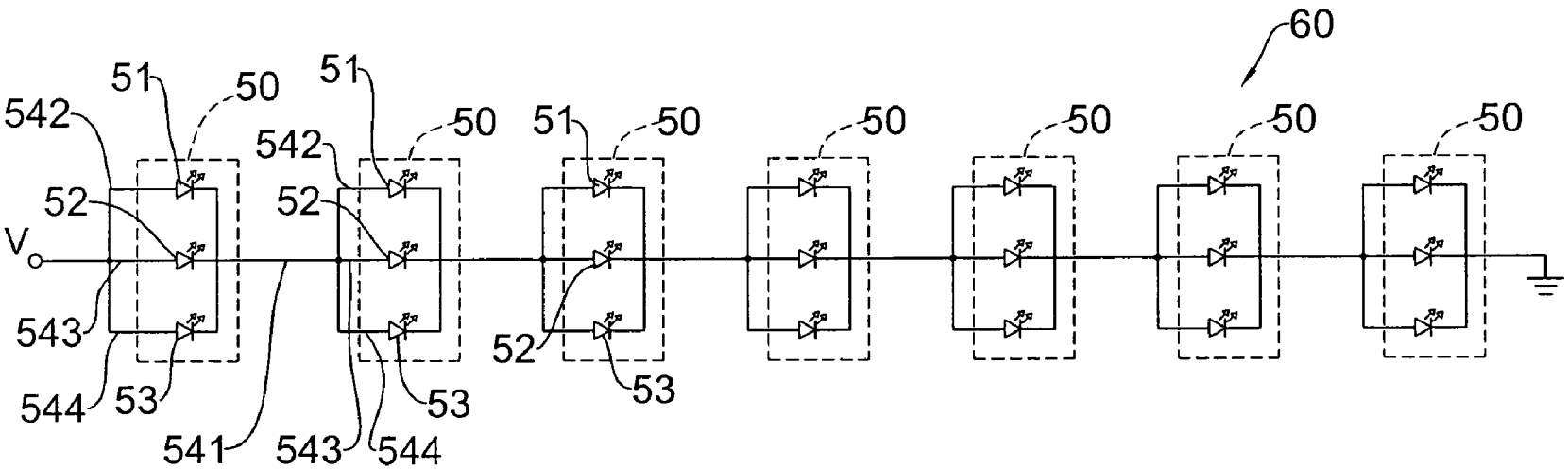
FIG. 5 PRIOR ART
FIG. 5 is an equivalent circuit diagram of the conventional LED light string in accordance with the prior art.

With reference to FIG. 3, an equivalent circuit diagram of an LED light string (20) of the present invention includes multiple LED components (10). The LED components (10) include multiple LED chips (11, 12 and 13) which are shown by an electric sign. Since the negative poles of the LED chips (11, 12 and 13) of the LED components (10) are not coupled together to connect to the ground, each LED chip (11, 12 or 13) can be regarded as a single light source. Hence, the present invention is to make multiple LED components (10) be connected in serial, and then to make the LED chips (11, 12 and 13) of corresponding color serially connected together, so as to form multicolor light string circuits. The multicolor light string circuits are respectively connected to corresponding voltage sources (V1, V2 and V3). The LED light string (20) in accordance with the present invention shows different light colors when different voltage sources (V1, V2 and V3) are respectively supplied to the light string (20) at different times.

While the invention has been described by way of example and in terms of a preferred embodiment, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

The invention claimed is:

1. A multicolor light-emitting diode (LED) light string comprising a plurality of serial connected LED components, wherein each LED component comprises:

multiple LED chips with different colors, wherein each chip has a positive pole and a negative pole;

multiple pairs of positive and negative pins each having an upper portion and a lower portion, wherein the upper portions of the positive pins are respectively connected to the positive poles of the LED chips and the lower portions of the negative pins are respectively connected by wires the negative poles of the LED chips; and a housing sealing the LED chips and the upper portions of the positive and negative pins, and the lower portions of the positive and negative pins being exposed outside the housing;

wherein the LED chips with the same light colors of the LED components are serially connected through the positive and negative pins.

2. A multicolor light-emitting diode (LED) component comprising:

multiple LED chips having different voltages to illuminate different light colors, wherein each LED chip has a positive pole and a ground connection pole;

a chip stand comprising multiple pairs of positive and negative pins, each pin having an upper portion and a lower portion, wherein the upper portions of the positive pins are respectively connected to the positive poles of the LED chips and the lower portions of the negative pins are respectively connected the negative poles of the LED to constitute a serially connected LED component, wherein the LED light string uses different external voltages to electronically chips to constitute a serially connected LED component wherein the LED light string uses different external voltages to electronically connect to corresponding serially connected LED components for lighting; and a housing sealing the LED chips and the upper portions of the positive and negative pins, and the lower portions of the positive and negative pins being exposed outside of the housing.

* * * * *